US006932008B2

(12) United States Patent
Pfeifer

(10) Patent No.: US 6,932,008 B2
(45) Date of Patent: Aug. 23, 2005

(54) QUILTING TABLE FOR A SEWING MACHINE

(76) Inventor: Thomas A. Pfeifer, 5118 W. Dahlia Dr., Glendale, AZ (US) 85304

( * ) Notice: Subject to any disclaimer, the term of this patent is extended or adjusted under 35 U.S.C. 154(b) by 0 days.

(21) Appl. No.: 10/762,384

(22) Filed: Jan. 21, 2004

(65) Prior Publication Data

US 2004/0182295 A1 Sep. 23, 2004

Related U.S. Application Data

(60) Provisional application No. 60/455,475, filed on Mar. 17, 2003.

(51) Int. Cl.[7] ..... D05B 11/00

(52) U.S. Cl. ..... 112/117; 112/470.13

(58) Field of Search ..... 112/470.12, 470.13, 112/217.1, 258, 102, 103, 117, 118, 119, 311; 38/102.21

(56) References Cited

U.S. PATENT DOCUMENTS

| | | | | | |
|---|---|---|---|---|---|
| 2,236,421 | A | * | 3/1941 | Boettcher | 112/118 |
| 4,192,241 | A | | 3/1980 | Reed et al. | |
| 4,470,361 | A | * | 9/1984 | Smith | 112/470.12 |
| 5,706,747 | A | * | 1/1998 | Tajima et al. | 112/258 |
| 5,711,236 | A | * | 1/1998 | Badger | 112/117 |
| 5,913,275 | A | | 6/1999 | Flynn | |
| 6,065,412 | A | * | 5/2000 | Schwarzberger et al. | 112/470.13 |
| 6,615,756 | B2 | | 9/2003 | Barrus | |
| 6,631,688 | B1 | | 10/2003 | Maag | |

OTHER PUBLICATIONS

"The Simple Quilter . . . ", http://users.eonet.net/quiltblocks/SimpleQuilter.html, Jan. 7, 2004, In public use prior to Mar. 17, 2003.

"Ken Quilt, KQ622 Features" http://www.kenquilt.com/622.html, Jan. 7, 2004. In public use prior to Mar. 17, 2003.

"SuperQuilter Home Quilting System —Anything else is a compromise ... "http://www.superquilter.com/top/html, Jan. 7, 2004. In public use prior to Mar. 17, 2003.

"Gammill Quilting Systems" http://www.gammill.net/stands.html, Jan. 7, 2004. In public use prior to Mar. 17, 2003.

"To Be Quilting —Home of the B–Line Home Quilting System" http://www.tobequilting.com/Features.htm, Jan. 7, 2004. In public use prior to Mar. 17, 2003.

"GMQ No–Baste Machine Quilter" http://www.graceframe.com/staticpages/index.php/GMQ?Graceid=f317f4d2d2395c99fd282bf65b5b5988b&Gra ... ,Jan. 7, 2004. InPublic use prior to Mar. 17, 2003.

"Hinterberg Design Quilting Hoops and Frames" Http://www.hinterberg.com/machine.htm, Jan. 7, 2004. In use prior to Mar. 17, 2003.

"Handi Quilter Home Machine Quilting Solutions"to http://www.handiquilter.com, Jan. 7, 2004. In public use prior to Mar. 2003.

* cited by examiner

*Primary Examiner*—Ismael Izaguirre

(57) ABSTRACT

A quilting table (20) includes a frame (22) having box channel rails (50, 52), a first carriage (212), moveable relative to a longitudinal dimension (30) of the frame (22), having wheels (224) engaged with the box channel rails (50, 52), and a second carriage (214), moveable relative to a transverse dimension (32) of the frame (22), supporting a sewing machine (34). A fabric support system (24) includes three fabric payout bars (128, 130, 132) and a take-up bar (134). Compressive force is utilized between the bars (128, 130, 132, 134) and their supports (120, 122) for fabric tensioning. The bars have a rectangular cross-sectional shape and indicia (190) for facilitating fabric placement. An overhead shelf (28) extends across dimension (30) of the frame (22) so that an operator on a needle side (51) of the quilting table (20) can currently view a quilting guide (268) and the fabric (206).

21 Claims, 10 Drawing Sheets

QUILTING TABLE FOR A SEWING MACHINE

RELATED INVENTION

The present invention claims priority under 35 U.S.C. §119(e) to: "MACHINE QUILTING TABLE," U.S. Provisional Patent Application Ser. No. 60/455,475, filed 17 Mar. 2003, which is incorporated by reference herein.

TECHNICAL FIELD OF THE INVENTION

The present invention relates to the field of quilting equipment. More specifically, the present invention relates to quilting tables for use with conventional sewing machines.

BACKGROUND OF THE INVENTION

Quilting has been in practice for many years, initially for utilitarian purposes, and more recently as a way of artistic expression. The continued popularity of the craft has lead to the development of modern textiles, equipment, and labor-saving sewing devices.

Quilting typically entails sewing two layers of cloth with a layer of insulating batting in between, thus forming a quilt. Quilts may be formed in a variety of shapes and styles that are variously used to cover beds, to decorate walls, used as lap cloths, and so forth. Designs and patterns are typically sewn, or stitched, into a quilt by hand or with a sewing machine to secure the two layers of cloth and the layer of batting together. Complex designs and patterns are often hand-stitched by a skilled craftsperson due to the complications involved with attempting to manipulate an unwieldy, multilayered fabric sandwich under the needle bar of a conventional sewing machine. However, such hand-stitching can be too time consuming for a skilled craftsperson, and may be too challenging for those who are not as skilled at hand-stitching. In addition, hand-stitching may be difficult or even impossible for those with limited mobility of their fingers, such as for an individual who has arthritis.

Thus, much attention has been directed toward the development of specialized sewing machines, known as "long arm" machines, which have a deeper throat for better accommodating the large fabric. Unfortunately, long arm sewing machines can be complex, bulky, and undesirably costly for the average hobbyist. Furthermore, if a hobbyist already has a conventional, household sewing machine, the additional long arm sewing machine presents commensurate storage related problems. For these reasons, many hobbyists would prefer to use their conventional, household sewing machine.

By merely utilizing a long arm machine or a household sewing machine, the hobbyist must still manipulate the quilt relative to the machine which can be difficult, and cause puckering and stitching errors. Accordingly, market demand has lead to the development of quilting devices for holding the fabric to be quilted and moving the sewing machine relative to the fabric. A typical quilting device includes a frame system for holding the fabric to be quilted, and a platform supporting a sewing machine for moving the sewing machine relative to the fabric. Generally, the frame holds one or more payout rollers, onto which fabric is rolled, and a take-up roller. The take-up roller is typically directed through the throat of the sewing machine so that fabric suspended between the payout rollers and the take-up roller can be passed under the needle bar of the sewing machine for machine stitching. The platform typically includes two carriages, one sitting upon the other. One carriage moves in a longitudinal direction, and the other carriage moves upon the first carriage in a transverse direction. The platform can then be manually manipulated by the user to impart a stitch pattern onto the fabric.

Several problems exist with these prior art quilting devices. For example, the wheels of the carriages typically sit upon track systems. Unfortunately, wheels setting upon a track have a tendency to become derailed, which can be inconvenient and/or lead to equipment damage. In addition, some track systems, particularly those configured to sit upon a tabletop, are formed with interconnecting track sections. These track sections can disassemble in operation also leading to derailment of the wheels.

The rollers used on conventional quilting devices are typically cylindrical, and each includes a ratchet mechanism having a gear and pawl for locking the roller and holding the fabric at a desired tension. Unfortunately, the use of a gear and pawl provides stepwise tensioning. Consequently, a user may have to decide whether the fabric should be tensioned too much or less than a desired amount of fabric tensioning. Inappropriate tensioning of the fabric can lead to puckering or loose stitches, which is obviously undesirable to the look of the finished product.

Some prior art quilting devices require the user to manipulate the sewing machine from the rear of the machine. In addition, the quilting device may include a stylus or laser pointer coupled to the moving carriage. A quilting guide can be followed by moving the carriage, thus moving the stylus, to impart a quilting pattern onto the fabric. The pointer and quilting guide are located near the rear of the machine within access by the user. Unfortunately, a rear driven machine and stylus located near the rear of the machine results in poor visibility of the fabric under the needle bar. As such, it is difficult for the user to visualize both the traced pattern and the sewn fabric concurrently to verify the accuracy of the stitching.

Still other problems exist with prior quilting devices in terms of complexity of setup, bulky size, difficulty of fabric loading onto the rollers, and so forth. Accordingly, what is needed is a quilting table that substantially mitigates the aforementioned problems.

SUMMARY OF THE INVENTION

Accordingly, it is an advantage of the present invention that a quilting table for use with a sewing machine is provided.

It is another advantage of the present invention that the quilting table is provided in which wheel derailment is largely prevented.

Another advantage of the present invention is that a quilting table is provided that has user selectable fabric tensioning capability.

Another advantage of the present invention is that a quilting table is provided with concurrent visibility of both a quilting guide and the fabric.

Yet another advantage of the present invention is that a quilting table is provided that is readily assembled, and facilitates the loading and alignment of fabric onto the quilting table.

The above and other advantages of the present invention are carried out in one form by a quilting table for use with a sewing machine. The quilting table includes a frame having first and second side rails. The first and second side rails support a front box channel rail in opposing relationship with a rear box channel rail. The front and rear rails define a longitudinal dimension of the frame, and the first and second side rails define a transverse dimension of the frame. A first carriage has first grooved wheels engaged with first and second facing edges of the front and rear box channel rails, the first carriage being moveable relative to the longitudinal dimension. A second carriage supports the sewing machine. The second carriage has second wheels engaged with opposing rails of the first carriage and is moveable relative to the transverse dimension.

The above and other advantages of the present invention are carried out in another form by a quilting table for use with a sewing machine. The quilting table includes a frame having first and second side rails supporting a front box channel rail in opposing relationship with a rear box channel rail. The front and rear rails define a longitudinal dimension of the frame, and the first and second side rails define a transverse dimension of said frame. A first carriage has first grooved wheels engaged with first and second facing edges of the front and rear box channel rails, the first carriage being moveable relative to the longitudinal dimension. A second carriage supports the sewing machine. The second carriage has second grooved wheels engaged with third and fourth facing edges of opposing box channel rails of the first carriage, the second carriage being moveable relative to the transverse dimension. A first support is coupled to the first side rail, and a second support is coupled to the second side rail. A payout bar extends between the first and second supports. The payout bar includes a first end rotatably engaged with the first support. The payout bar is configured to have a fabric wound thereon. A first stop is coupled to the first end for imparting a first compressive force to the first support and the payout bar for selectively preventing rotation of the payout bar. A take-up bar extends between the first and second supports. The take-up bar includes a second end rotatably engaged with the first support, and the take-up bar being configured to have the fabric wound thereon as the fabric is unwound from the payout bar. A second stop is coupled to the second end for imparting a second compressive force to the first support and the take-up bar for selectively preventing rotation of the take-up bar.

The above and other advantages of the present invention are carried out in yet another form by a quilting table for use with a sewing machine. The quilting table includes a frame having first and second side rails supporting a front rail in opposing relationship with a rear rail. The front and rear rails define a longitudinal dimension of the frame, and the first and second side rails define a transverse dimension of the frame. A first carriage has first wheels engaged with the front and rear rails and is moveable relative to the longitudinal dimension. A second carriage has second wheels engaged with opposing rails of the first carriage and is moveable relative to the transverse dimension. The second carriage has a front edge facing the front rail and a back edge facing the rear rail. The second carriage is adapted to support the sewing machine with a machine head of the sewing machine facing the front edge. A handle is mounted on the second carriage proximate the front edge for manually translating the first and second carriages along the longitudinal and transverse dimensions. A first shelf support extends from the first side rail, and a second shelf support extends from the second side rail. A pattern shelf is coupled to each of the first and second shelf supports and extends across the longitudinal dimension of the frame.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
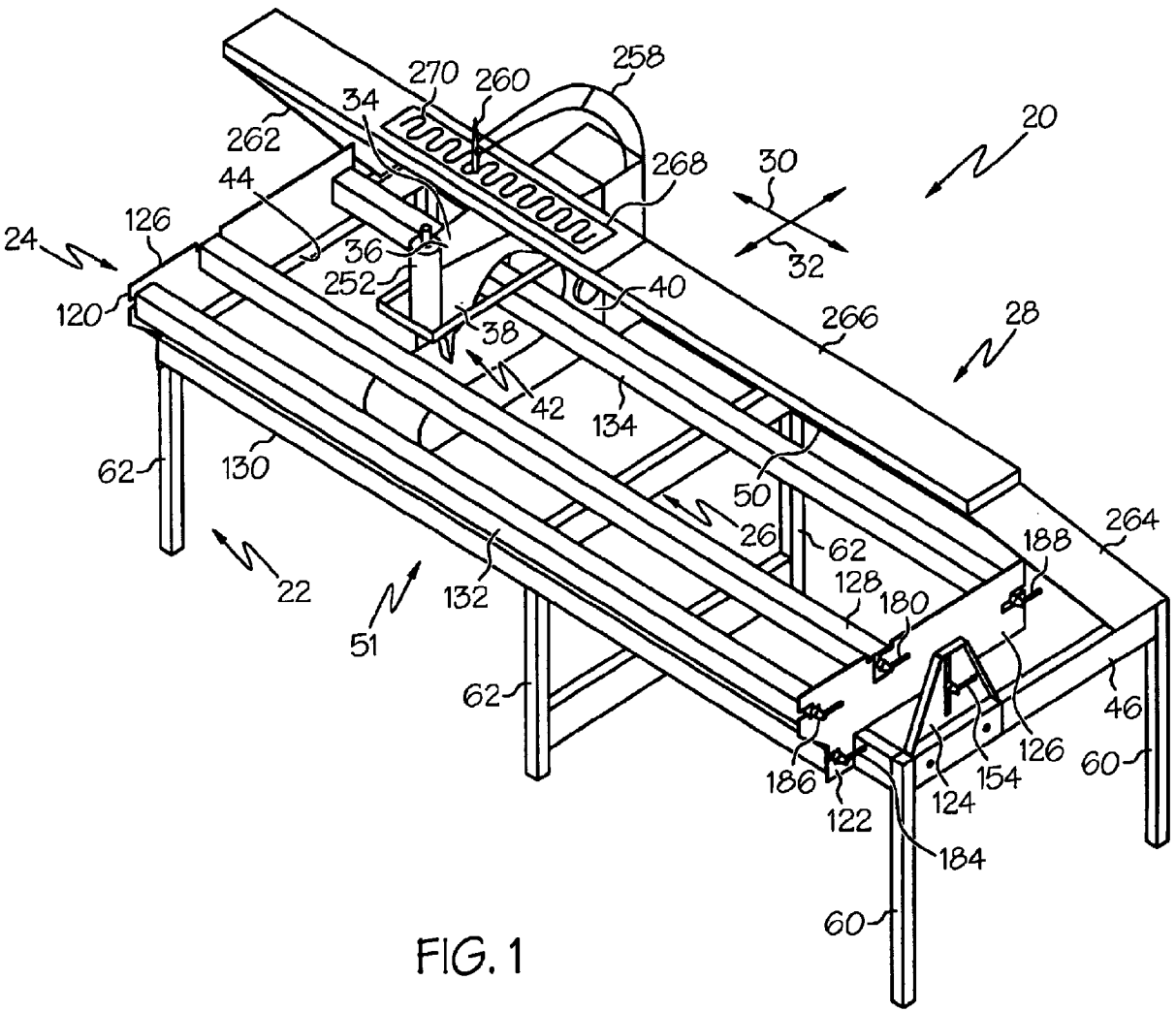
FIG. 1 shows a front perspective view of a quilting table in accordance with a preferred embodiment of the present invention.

FIG. 1 shows a front perspective view of a quilting table 20 in accordance with a preferred embodiment of the present invention. Quilting table 20 generally includes a frame 22, a fabric support system 24, a platform assembly 26, and an overhead shelf 28. Platform assembly 26 is moveable relative to a longitudinal dimension 30 and a transverse dimension 32 of frame 22. In a preferred embodiment, platform assembly 26 supports and transports a conventional, household sewing machine 34 having a machine head 36 on the end of an arm 38 extending from a base structure 40. The open region beneath arm 38 and between each of machine head 36 and base structure 40 is commonly referred to as a throat 42.

Figure 2:
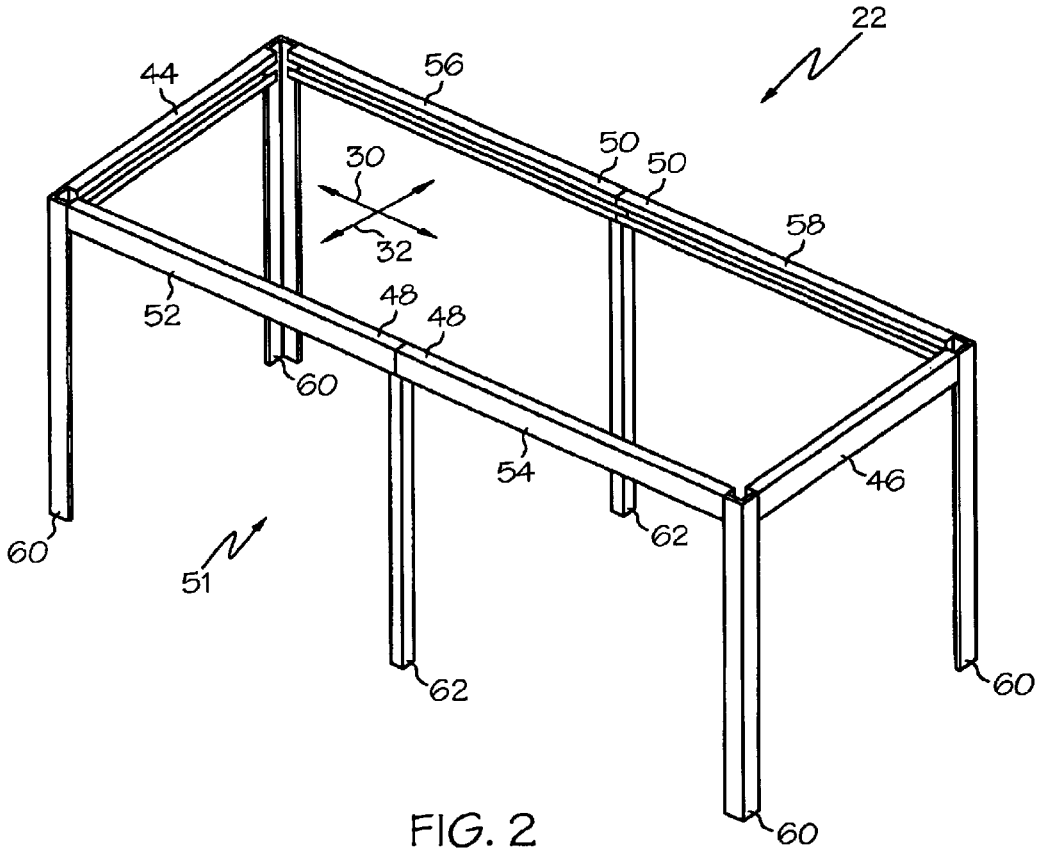
FIG. 2 shows front perspective view of a frame of the quilting table.

Referring to FIG. 2 in connection with FIG. 1, FIG. 2 shows front perspective view of frame 22. Frame 22 includes a first side rail 44 and a second side rail 46 supporting a front box channel rail 48 and a rear box channel rail 50. Front and rear box channel rails 48 and 50, respectively, define longitudinal dimension 30 of frame 22, and first and second side rails 44 and 46, respectively, define transverse dimension 32 of frame 22. In addition to front and rear rails 48 and 50 being box channel rails, first and second side rails 44 and 46, respectively, are also box channel, or C-channel, rails. The use and advantages of box channel rails will be discussed in further detail below.

Front box channel rail 48 is located on a front, or needle side 51, of quilting table 20. In such a configuration, an individual may be located at and operate sewing machine 34 from needle side 51 of quilting table 20. As such, the fabric is readily visible to the individual as the fabric is being stitched.

As particularly illustrated in FIG. 2, front and rear box channel rails 48 and 50, respectively, may be assembled from two sections. That is, front box channel rail 48 may include a first section 52 and a second section 54. Similarly, rear box channel rail 50 may include a third section 56 and a fourth section 58. In an exemplary embodiment, each of sections 52, 54, 56, and 58 may be approximately fifty-eight inches long. When first and second sections 52 and 54 are coupled end to end, and when third and fourth sections 56 and 58 are coupled end to end, frame 22 can accommodate a quilt up to one hundred and five inches in width. Accordingly, a "king sized" quilt can be readily stitched.

Alternatively, a much narrower quilt (for example, less than forty-seven inches) may fit more conveniently when frame 22 is assembled with only one of first and second sections 52 and 54, respectively, for front box channel rail 48 and with only one of third and fourth sections 56 and 58, respectively, for rear box channel rail 50. Of course, those skilled in the art will recognize that front and rear box channel rails 48 and 50 can be formed in a variety of lengths and a number of sections to conveniently accommodate a variety of quilt widths. When not in use and during assembly, the multiple shorter sections are easier to store and easier to handle than one long rail.

Legs 60 are positioned at each of the corners of frame 22. In addition, center support legs 62 may also be positioned at the intersection of each of first and second sections 52 and 54, respectively, and third and fourth sections 56 and 58, respectively. The box channel construction of first and second side rails 44 and 46, respectively, and front and rear rails 48 and 50, enable convenient interconnection with legs 60 and center support legs 62 (shown below).

Figure 3:
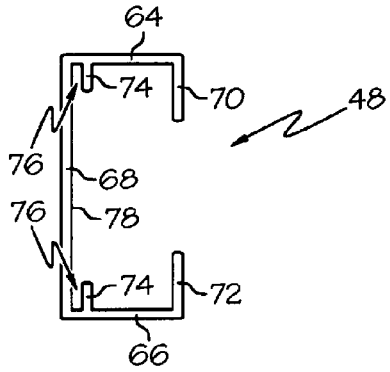
FIG. 3 shows an end view of a box channel rail of the frame.

FIG. 3 shows an end view of front box channel rail 48 of frame 22. However, the following discussion pertains equally to rear box channel rail 50 (FIG. 2), as well as to first and second side rails 44 and 46 (FIG. 2). Front box channel rail 48 includes first and second end walls 64 and 66, respectively, interconnected by a spanning wall 68. Rail 48 further includes an inwardly turned first edge 70 extending from first end wall 64. First edge 70 faces an inwardly turned second edge 72 extending from second end wall 66. Each of first and second end walls 64 and 66 further includes a rib member 74 projecting into an interior of front box channel rail 48, thus establishing slots 76 between rib members 74 and an inner surface 78 of spanning wall 68.

Figure 4:
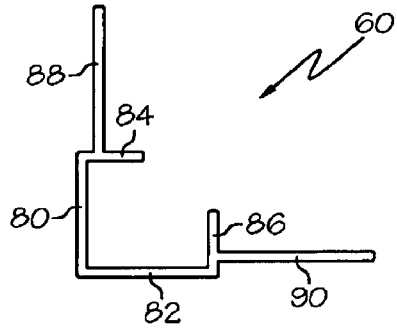
FIG. 4 shows an top view of one of the legs of the frame.

FIG. 4 shows a top view of one of legs 60. Leg 60 includes first and second adjoining side walls 80 and 82, respectively. A first auxiliary wall 84 projects approximately perpendicularly from an edge of first side wall 80, and a second auxiliary wall 86 projects approximately perpendicular from an edge of second side wall 82, to form a generally rectangular, and more specifically, square, cross-sectional shape of leg 60. A first fin 88 extends from an exterior side of first auxiliary wall 84, and a second fin 90 extends from and exterior side of second auxiliary wall 86.

Figure 5:
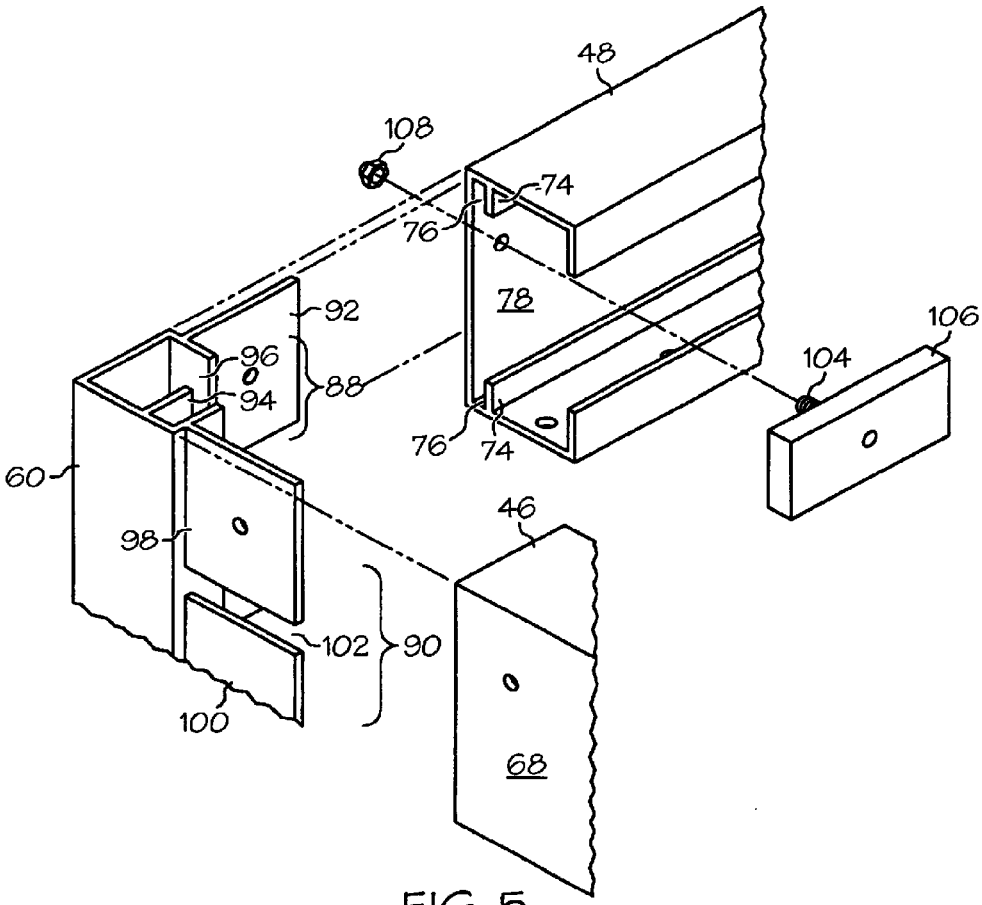
FIG. 5 shows an exploded perspective view of a portion of a front box channel rail and a side channel rail being assembled with a leg of the frame of FIG. 2.

FIG. 5 shows an exploded perspective view of a portion of front box channel rail 48 and second side channel rail 46 being assembled with one of legs 60 of frame 22. However, the following discussion pertains equally to the interconnection of the remaining legs 60 at each of the corners of frame 22. As shown, first fin 88 of leg 60 is split to form a shortened first tab 92 and a remaining fin section 94, with a gap 96 extending between first tab 92 and fin section 94. Likewise, second fin 90 of leg 60 is split into a second tab 98 and a remaining fin section 100, with a gap 102 extending between second tab 98 and fin section 100.

First and second tabs 92 and 98 facilitate ready coupling of leg 60 with front box channel rail 48 and second side rail 46. In particular, first tab 92 is slid into slots 76 between rib members 74 and an inner surface 78 of spanning wall 68 of front box channel rail 48 and second tab 98 is slid into slots 76 (not visible) between rib members 74 (not visible) and inner surface 78 (not visible) of spanning wall 68 of second side rail 46.

Once first tab 92 is slid into slots 76 of front box channel rail 48, a stud 104 extending from a stud plate 106 is slid through aligned apertures. An acorn nut 108 is then coupled to stud 104. An additional stud plate 106 and acorn nut 108 may be used to couple second tab 98 with second side rail 46. A gusset (not shown) may be attached in the corner formed between leg 60, front box channel rail 48, and second side rail 46 to further strengthen the corner.

Figure 6:
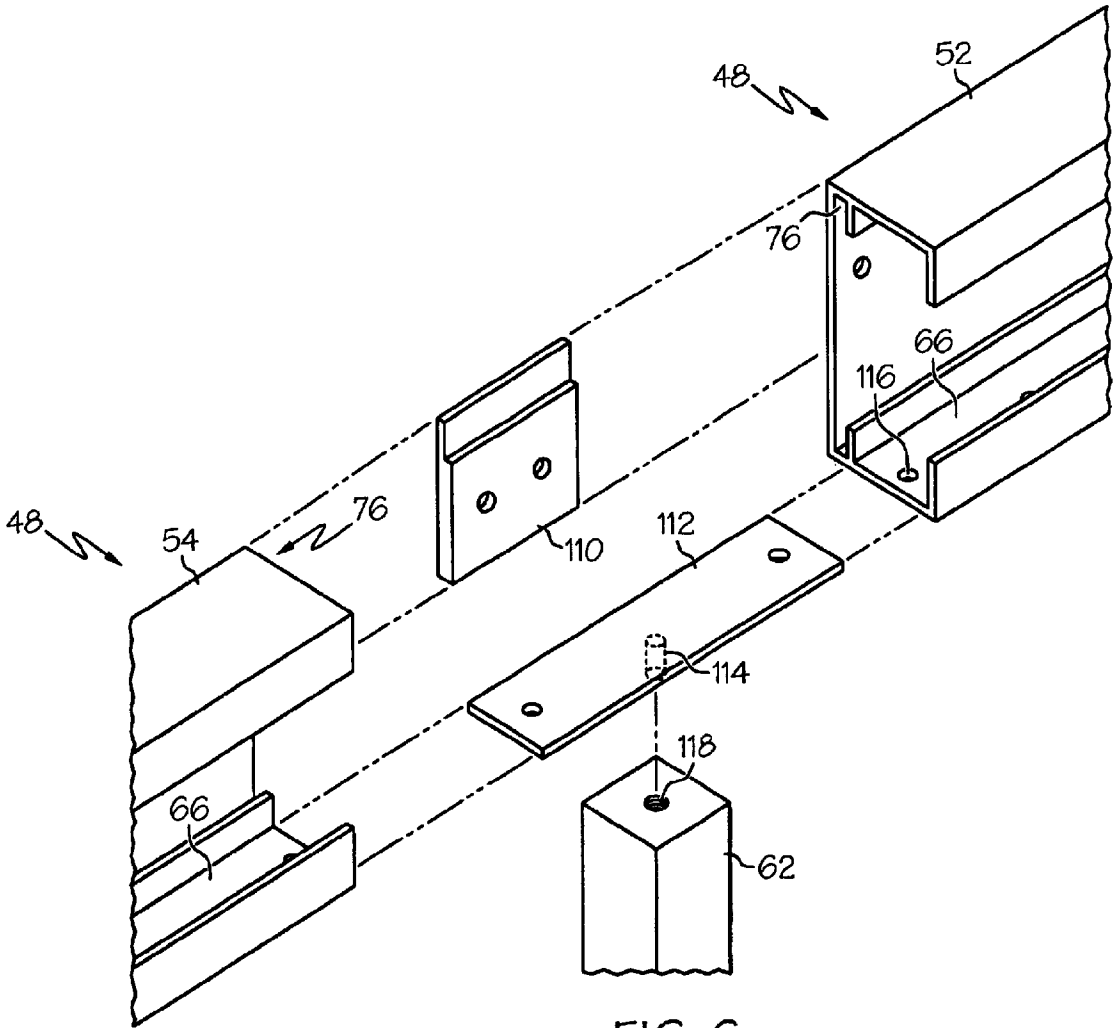
FIG. 6 shows an exploded perspective view of a portion of a first section and a second section of the box channel rail of FIG. 3 being assembled with a center support leg.

FIG. 6 shows an exploded perspective view of a portion of first section 52 and second section 54 of front box channel rail 48 being assembled with one of center support legs 62. A frame rail plate 110 is slid into the upper slots 76 of each of first and second sections 52 and 54, respectively. Stud plates 106 and acorn nuts 108, such as that shown in FIG. 5, may be utilized to couple frame rail plate 110 through aligned apertures in each of first and sections 52 and 54.

In addition, a frame rail connector bar 112 is installed against second end wall 66 of each of first and second sections 52 and 54. Stud plates 106 and acorn nuts 108 may be utilized to couple frame rail connector bar 112 through aligned apertures in each of first and sections 52 and 54. A threaded stud 114 (shown in ghost form) projects downwardly from frame rail connector bar 112. Stud 114 is directed through an aligned aperture 116 on one of first and second sections 52 and 54, respectively. Center support leg 62 includes a threaded opening 118. Thus, center support leg 62 can be threaded onto stud 114 to secure center support leg 62 to frame 22.

Referring back to FIG. 1, fabric support system 24 generally includes a first support 120 coupled to first side rail 44 and a second support 122 coupled to second side rail 46. Each of first and second supports 120 and 122, respectively, includes a lower mount section 124 and an upper mount section 126. Fabric support system 24 further includes first, second, and third payout bars 128, 130, and 132, respectively, that extend between first and second supports 120 and 122, respectively. In addition, a receiving, or take-up, bar 134 extends between first and second supports 120 and 122, respectively. First, second, and third payout bars 128, 130, and 132, respectively, are positioned in front of machine head 36 of sewing machine 34 at needle side 51 of quilting table 20, and take-up bar 134 is directed through throat 42 of sewing machine 34.

Figure 7:
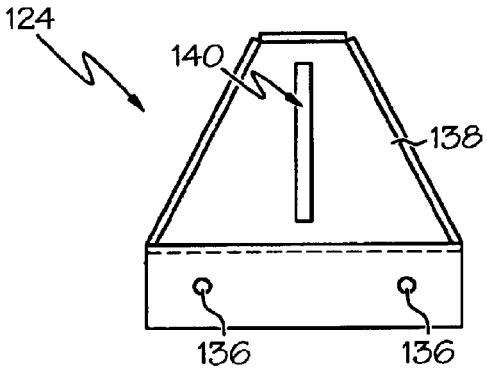
FIG. 7 shows a front view of lower mount section of one of first and second supports that is coupled to a side rail of the frame.
Figure 8:
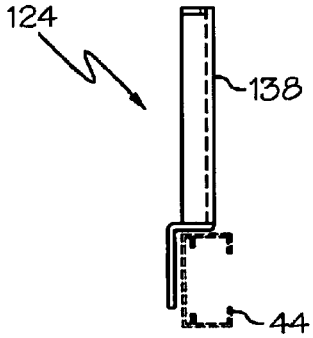
FIG. 8 shows a side view of the lower mount section.

Referring to FIGS. 7–8 in connection with FIG. 1, FIG. 7 shows a front view of lower mount section 124 of one of first and second supports 120 and 122, and FIG. 8 shows a side view of lower mount section 124. Lower mount section 124 includes apertures 136 through which fasteners (not shown) may be passed to attach lower mount section 124 to either of first and second side rails 44 and 46, respectively, (FIG. 2) of frame 22. In addition, a body 138 of lower mount section 124 includes a slotted opening 140. Slotted opening 140 will be discussed in greater detail below.

Figure 9:
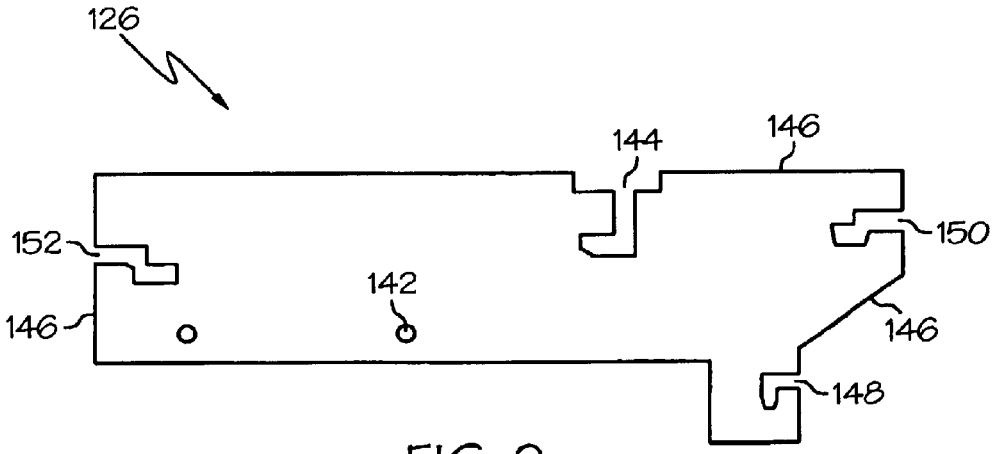
FIG. 9 shows a front view of an upper mount section of one of the first and second supports.

FIG. 9 shows a front view of upper mount section 126 of one of first and second supports 120 and 122. Upper mount section 126 includes a threaded stud 142 for adjustable attachment to lower mount section 124, discussed below. In addition, upper mount section 126 includes a first slotted aperture 144 located along a top edge and inwardly extending from the perimeter 146 of upper mount section 126. Similarly, a second slotted aperture 148 is located along a lower front edge and inwardly extends from perimeter 146 of upper mount section 126. A third slotted aperture 150 is located above second slotted aperture 148 and inwardly extends from perimeter 146. A fourth slotted aperture 152 is located along a rear edge and inwardly extends from perimeter 146 of upper mount section 126.

Each of first, second, third, and fourth slotted apertures 144, 148, 150, and 152 provide a location on upper mount section 126 into which a corresponding one of first, second, third payout bars 128, 130, and 132, as well as, take-up bar 134 may be seated. The angled aspect of each of apertures 144, 148, 150, and 152 allows end studs (discussed below) of each of bars 128, 130, 132, and 134 to be readily slid into their corresponding apertures 144, 148, 150, and 152. Once seated in apertures 144, 148, 150, and 152, bars 128, 130, 132, and 134 cannot readily be inadvertently pulled out of apertures 144, 148, 150, and 152. In addition, apertures 144, 148, 150, and 152 are sized to enable the ends (discussed below) of bars 128, 130, 132, and 134 to freely rotate in apertures 144, 148, 150, and 152.

Figure 10:
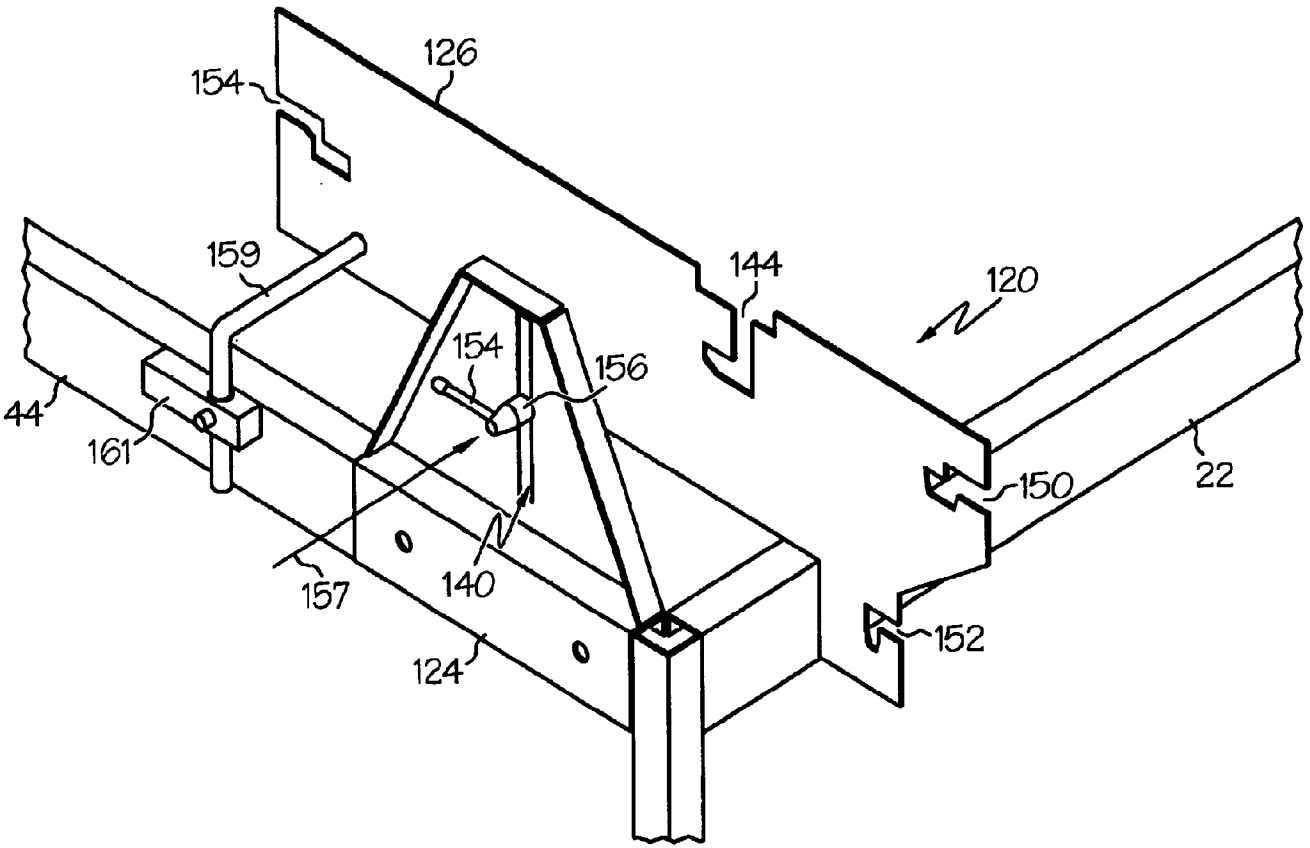
FIG. 10 shows a partial perspective view of the lower and upper mount sections of the first support coupled to the side rail of the frame.

FIG. 10 shows a partial perspective view of lower and upper mount sections 124 and 126, respectively, of first support 120 coupled to first side rail 44 of frame 22. It should be understood that the following discussion applies equivalently to second support 122. Lower mount section 124 is bolted to first side rail 44. Threaded stud 142 (FIG. 9) of upper mount section 126 is then directed through slotted opening 140 of lower mount section 124. First support 120 further includes a T-handle 154. T-handle 154 includes a body 156 having a threaded opening (not visible) extending into body 156. Accordingly, T-handle 154 can be secured to stud 142, thereby holding lower and upper mount sections 124 and 126, respectively, together. Upper mount section 124 is vertically adjustable by merely sliding stud 142 within slotted aperture 140. Once adjusted, T-handle 154 is simply rotated to apply compressive force, represented by an arrow 157, against lower and upper mount sections 124 and 126, respectively. In addition, a rod 159 of a lock mechanism 161, attached to first side rail 44, may be hooked through upper mount section 126 to prevent upper mount section 126 from pivoting about T-handle 154.

Figure 11:
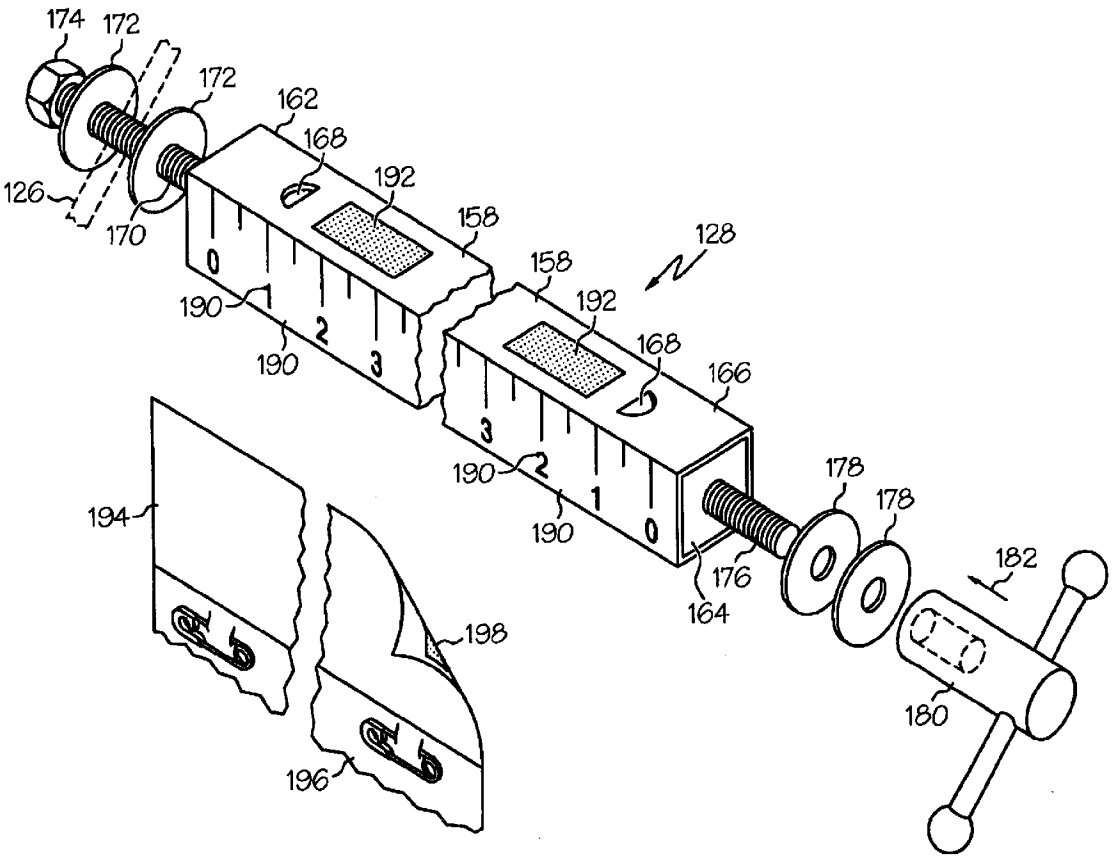
FIG. 11 shows a partial perspective view of a payout bar in accordance with a preferred embodiment of the present invention.
Figure 12:
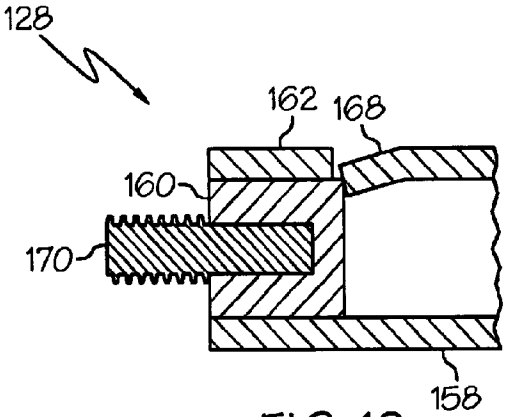
FIG. 12 shows a side sectional view of the payout bar of FIG. 11.

Referring to FIGS. 11 and 12, FIG. 11 shows a partial perspective view of first payout bar 128 in accordance with a preferred embodiment of the present invention, and FIG. 12 shows a side sectional view of first payout bar 128 of FIG. 11. Although only first payout bar 128 is shown, the following discussion applies equivalently to second and third payout bars 130 and 132, as well as to take-up bar 134.

First payout bar 128 generally includes a tube 158 exhibiting a generally rectangular cross-sectional shape. A first tube end 160 is seated in a first end 162 of tube 158 and a second tube end 164 is seated in a second end 166 of tube 158. Tube 158 is lanced at each of first and second ends 162 and 166 to form a stop 168. First and second tube ends 160 and 164, respectively, are slid into first and second ends 162 and 166, respectively, until they abut stops 168. Thus, stops 168 hold first and second tube ends 160 and 164 at the appropriate depth in tube 158.

First tube end 160 includes a first threaded stud 170 extending therefrom. A pair of washers 172 may be retained on first threaded stud 170 with a locking nut 174. Second tube end 164 includes a second threaded stud 176 extending therefrom. Another pair of washers 178 may be retained on second threaded stud 176 with a first stop, i.e., a first T-handle 180. In practice, first threaded stud 170 is directed through first slotted aperture 144 (FIG. 10) of upper mount section 126 of first support 120 (FIG. 10) with washers 172 seated on either side of upper mount section 126. Likewise, second threaded stud 176 is directed through first slotted aperture 144 of upper mount section 126 of second support 122 (FIG. 1) with washers 178 seated on either side of upper mount section.

First slotted apertures 144 (FIG. 10) are sized to enable first and second threaded studs 170 and 176, respectively, to rotate freely in apertures 144. However, when T-handle 180 is tightened, T-handle 180 applies a compressive force, represented by an arrow 182, to upper mount section 126 and first payout bar 128 to selectively prevent (i.e., stop) rotation of first payout bar 128. Referring momentarily to FIG. 1, a second T-handle 184 is coupled to an end of second payout bar 130, a third T-handle 186 is coupled to an end of third payout bar 130, and a fourth T-handle 188 is coupled to an end of take-up bar 132. Second, third, and fourth T-handles 184, 186, and 188, respectively, are operated similar to T-handle 180 to apply compressive force between upper mount section and the respective second payout bar 130, third payout bar 132, and take-up bar 134 to selectively prevent rotation.

With reference back to FIGS. 11–12, tube 158 of first payout bar 128 further includes indicia 190 marked thereon. In a preferred embodiment, indicia 190 are matching from first and second ends 162 and 166, respectively. For example, indicia 190 may be numerals marked off in units, such as inches, that count up from a lowest number from each of first and second ends 162 and 166.

In practice, a leader fabric 194 is coupled to one end of a fabric, for example, a quilt top 196, to be stitched. A loop portion 198 of the hook and loop fastener is sewn to leader fabric 194. Loop portion 198 on leader fabric 194 is attached to hook portion 192. Quilt top 196 is centered on tube 158 by utilizing indicia 190 and quilt top 196 is wound onto tube 158. Accordingly, indicia 190 facilitate the placement of quilt top 196 on first payout bar 128. This procedure is followed to place a quilt backing fabric (discussed below) on third payout bar 132 (FIG. 1). Batting (discussed below) is placed on second payout bar 130. However, the batting need not be coupled to a leader fabric because the batting is able to couple directly to hook portion 192 on second payout bar 130. In an alternative embodiment, loop portion 198 of the hook and loop fastener may be coupled to first and third payout bars 128 and 132, respectively, as well as to take-up bar 134. As such, hook portion 192 would then be sewn onto leader fabric 194.

Figure 13:
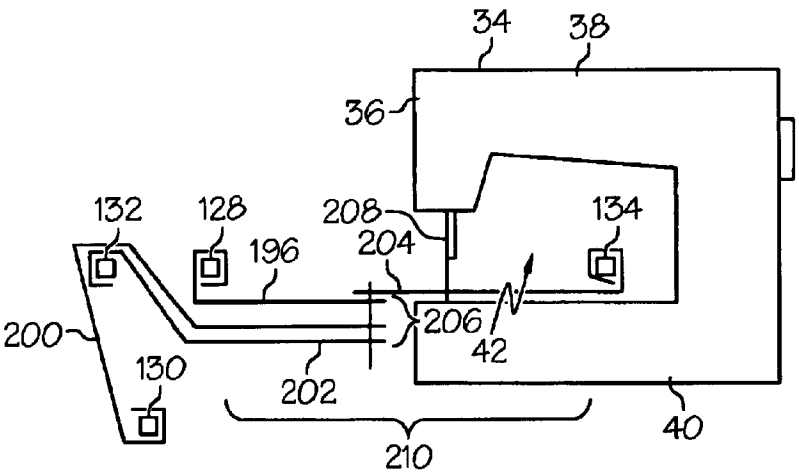
FIG. 13 shows a block diagram of an arrangement of first, second, and third payout bars and a take-up bar relative to a sewing machine.

FIG. 13 shows a block diagram of an arrangement of first, second, and third payout and take-up bars 128, 130, 132, and 134 relative to sewing machine 34. A first fabric, i.e., quilt top 196, is wound on first payout bar 128. Batting 200 is wound on second payout bar 130, and a second fabric, referred to herein as a quilt backing 202 is wound on third payout bar 132. Quilt top 196, batting 200, and quilt backing 202, are secured to a take-up leader 204. Take-up leader 204 is wound onto take-up bar 134. As mentioned above, each of bars 128, 130, 132, and 134 can rotate in their respective apertures in first and second supports 120 and 122, respectively (FIG. 1). According, quilt top 196, batting 20, and quilt backing 202 can be concurrently unwound from first, second, and third payout bars 128, 130, and 132 to form a sandwich structure 206. Sandwich structure 206 is passed beneath a needle bar 208 of machine head 36 for stitching and is wound onto take-up bar 134.

The portion of sandwich structure 206 between first payout bar 128 and take-up bar 134 forms a working surface 210 to be stitched. Once working surface 210 is defined, fourth T-handle 188 (FIG. 1) is tightened to prevent rotation of take-up bar 134. First payout bar 128 is then rotated clockwise until quilt top 196 is fairly taut. First handle 180 (FIG. 1) is then tightened to prevent rotation of first payout bar 128. This procedure is repeated at third payout bar 132 (rotating third payout bar 132 counterclockwise) for quilt backing 202. Batting 200 need not be placed in tension. Nor is it necessary to tighten second handle 184 (FIG. 1). Although, a user may wish to do so to avoid having batting 200 unroll and fall to the floor.

Thus, the use of compressive force 182 (FIG. 11) via first, second, third, and fourth handles 180, 184, 186, and 188 provides a user with the capability to tension the quilt fabric at the desired amount of fabric tensioning so as to avoid puckering and loose stitches, thereby enhancing the appearance of the finished product.

Figure 14:
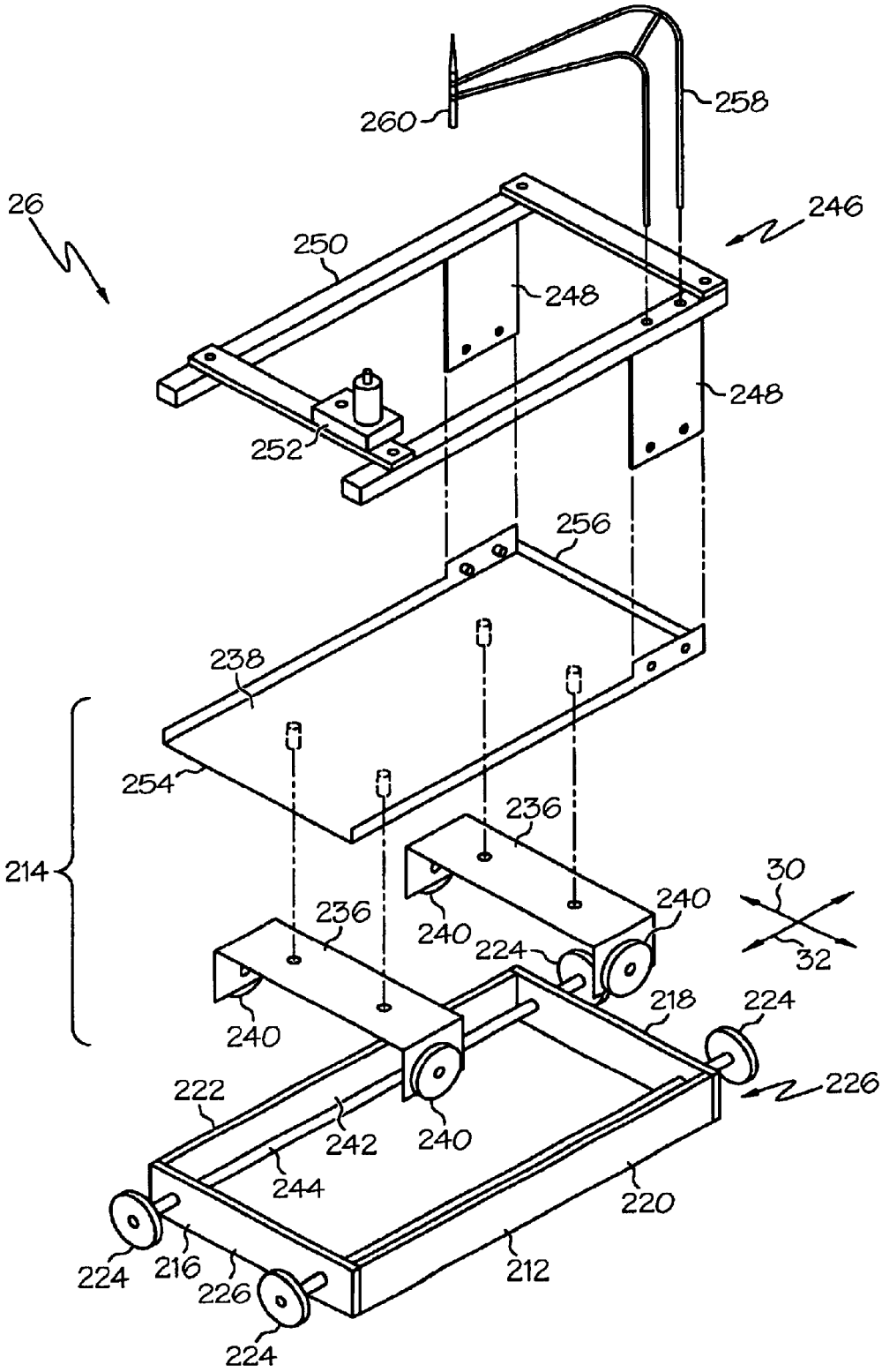
FIG. 14 shows an exploded perspective view of a platform assembly of the quilting table in accordance with a preferred embodiment of the present invention.

FIG. 14 shows an exploded perspective view of platform assembly 26 of quilting table 20 in accordance with a preferred embodiment of the present invention. As mentioned above, platform assembly 26 supports and transports sewing machine 34 (FIG. 1) relative to longitudinal and transverse dimensions 30 and 32, respectively. Platform assembly 26 generally includes a first carriage 212 and a second carriage 214.

First carriage 212 includes a first carriage rail 216 and a second carriage rail 218 supporting a first box channel rail 220 and a second box channel rail 222. Grooved wheels 224 are mounted on an outer surface 226 of each of first and second carriage rails 220 and 222, respectively. Grooved wheels 224 are configured to be engaged with front and rear box channel rails 48 and 50, respectively, of frame 22 (FIG. 2).

Figure 15:
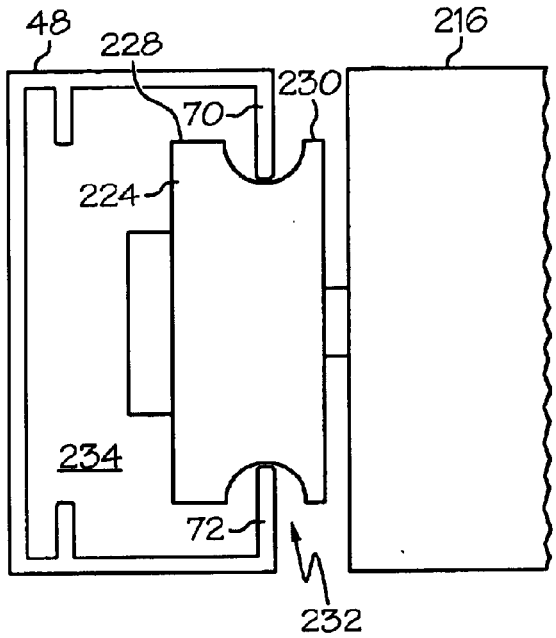
FIG. 15 shows a partial side view of the grooved wheel seated in the front box channel of FIG. 3.

Referring to FIG. 15 in connection with FIG. 14, FIG. 15 shows a partial side view of one of grooved wheels 224 seated in front box channel rail 48. Grooved wheel 224 includes a first wheel surface 228 and a second wheel surface 230 separated by a grooved region 232. As shown, the wider first wheel surface 228 resides in an interior 234 of front box channel rail 48, and the narrower second wheel surface 230 resides outside of front box channel rail 48. First and second facing edges 70 and 72, respectively, of front box channel rail 48 are contained in grooved region 232 between first and second wheel surfaces 228 and 230, respectively. Thus, grooved wheel 224 is rotatably engaged with first and edges 70 and 72 of front box channel rail 48. Although facing edge 70 is contained within grooved region 232, it should be apparent that in order for grooved wheel 224 to be able to freely rotate, facing edge 70 may not actually contact the surface of grooved wheel 224 within grooved region 232. In this manner, grooved wheel 224 can readily rotate along first and second edges 70 and 72 of each of front and rear box channel rails 48 and 50, respectively (FIG. 2), to move platform assembly 26 relative to longitudinal dimension 30 of frame 22 (FIG. 1). In addition, the engagement of grooved wheel 224 with both first and second edges 70 and 72 largely prevents grooved wheel 224 from becoming derailed.

Referring back to FIG. 14, second carriage 214 includes carriage supports 236 and a machine platform 238 secured to carriage supports 236 that supports sewing machine 34 (FIG. 1). Grooved wheels 240 are coupled to carriage supports 236. Grooved wheels 240 of second carriage 214 are arranged perpendicular to grooved wheels 224 of first carriage 212. In addition, grooved wheels 240 are configured to be engaged with first and second box channel rails 220 and 222 of first carriage 212.

Grooved wheels 240 are equivalent to grooved wheels 224, and engage with first and second box channel rails 220 and 222 in a manner similar to the engagement of grooved wheels 224 with front and rear box channel rails 48 and 50. Accordingly, third and fourth facing edges 242 and 244, respectively, of each of first and second box channel rails 220 and 222 are contained in grooved regions of grooved wheels 240. Thus, grooved wheels 240 can readily rotate along third and fourth facing edges 242 and 244 to move platform assembly 26 relative to transverse dimension 32 of frame 22 (FIG. 1). In addition, the engagement of grooved wheel 240 with third and fourth facing edges 242 and 244 largely prevents grooved wheels 240 from becoming derailed.

A handle support structure 246 is coupled to machine platform 238. Handle support structure 246 includes a pair of uprights 248 and a framework 250. A handle assembly 252 is mounted to framework 250 for manually translating first and second carriages 212 and 124, respectively, longitudinally and transversely relative to longitudinal dimension 30 and transverse dimension 32.

Machine platform 238 includes a front edge 254 facing front box channel rail 48 (FIG. 2) and a back edge 256 facing rear box channel rail 50 (FIG. 2). Machine platform 238 supports sewing machine 34 (FIG. 1) with machine head 36 (FIG. 1) facing front edge 254. In a preferred embodiment, handle assembly 252 is mounted to framework 250 proximate front edge 254 so that platform assembly 26 can be manipulated from needle side 51 (FIG. 1) of quilting table 20 (FIG. 1). Handle assembly 252 can be variously placed in a right front corner of framework 250 (as illustrated) for right-handed needle side operation or in a left front corner of framework 250 for left-handed needle side operation. Alternatively, framework 250 is configured such that handle assembly 252 can be placed in a right rear or left rear corner of framework 250 for traditional stitching from behind sewing machine 34.

Handle support structure 246 further supports pointer support 258 which holds a pointer 260. In a preferred embodiment, pointer 260 is a laser pointer. However, alternative pointing devices may be utilized, such as a pencil or pen.

Referring to FIG. 1 in connection with FIG. 14, quilting table 20 includes overhead shelf 28. Overhead shelf 28 includes a first shelf support 262 coupled to first side rail 44 of frame 22 proximate rear box channel rail 50, and a second shelf support 264 coupled to second side rail 46 of frame 22 proximate rear box channel rail 50. A pattern shelf 266 attaches to each of first and second shelf supports 262 and 264, respectively, and extends across longitudinal dimension 30 of frame 22.

First and second shelf supports 262 and 264, respectively, extend from first and second side rails 44 and 46 at a height sufficient to enable pattern shelf 266 to reside above frame 22 and sewing machine 34. In addition, first and second shelf supports 262 and 264 angle forward so that pattern shelf 266 is located above front box channel rail 48 (FIG. 2).

In practice, a quilting guide 268 having a stitch pattern 270 may be placed on pattern shelf 266. In a preferred embodiment, pointer support 258 extends above pattern shelf 266 and supports pointer 260 above pattern shelf 266 so that pointer 260 points downwardly toward stitch pattern 270. In addition, pointer support 258 extends over pattern shelf 260 such that pointer 260 is approximately axially aligned with needle bar 208 of sewing machine 34. Since pointer support 258 is secured to second carriage 214, as platform assembly 26 is manually directed relative to longitudinal and transverse dimensions 30 and 32, respectively, pointer 260 moves in conjunction with first and second carriages 212 and 214, respectively. Thus, an individual can trace stitch pattern 270 from quilting guide 268, while operating sewing machine 34 so that stitch pattern 270 is imparted on sandwich structure 206 (FIG. 13) suspended on frame 22. Moreover, when the individual utilizes quilting table 20 from needle side 51, the individual can concurrently visualize both working surface 210 (FIG. 13) and stitch pattern 270 to ascertain the accuracy of stitching.

Figure 16:
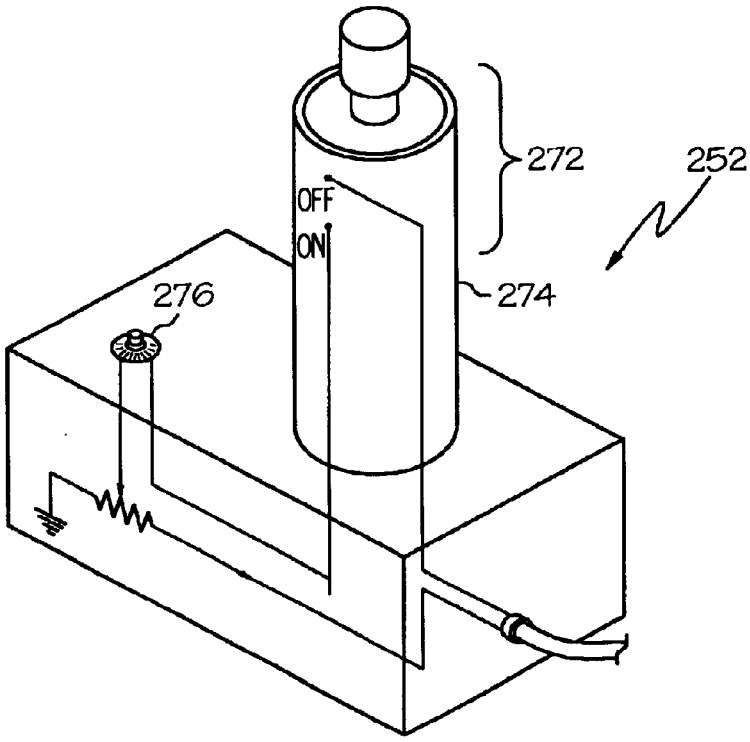
FIG. 16 shows a perspective view, overlaid with an exemplary block diagram, of a handle assembly of the quilting table.

FIG. 16 shows a perspective view, overlaid with an exemplary block diagram, of handle assembly 252 of quilting table 20. In order to facilitate operation of sewing machine 34 (FIG. 1) from needle side 51 (FIG. 1), handle assembly 252 includes the capability to both turn off and turn on sewing machine 34. In addition, handle assembly 252 includes the capability to adjust an operational speed of sewing machine 34.

To that end, handle assembly 252 includes a power on/power off switch 272 that is actuated at the end of a driving handle 274, and a speed control knob 276 for adjusting the operational speed of sewing machine 34. Speed control knob 276 may be, for example, a shaft of a potentiometer. As such, a variable resistance and potential is produced which in turn, adjusts the operational speed of sewing machine 34 when the shaft is turned via speed control knob 276. In operation, handle assembly 252 is connected to a conventional foot control socket (not shown) of sewing machine 34. When switch 272 is actuated, sewing machine turns on at the speed set at speed control knob 276.

In summary, the present invention teaches of a quilting table for use with a conventional or deeper throat sewing machine. The quilting table includes a free-standing frame and a platform assembly supporting the sewing machine and moveable on the frame. The wheels of the platform assembly reside in box channel rails to largely prevent wheel derailment. In addition, compressive force via T-handles is applied on fabric bars to selectively tension the fabric. The compressive force enables a user to tension the fabric at virtually any desired amount of tension. The quilting table further enables the user to drive the sewing machine from the needle side, and a pattern shelf residing above the sewing machine along the front of the quilting table enables the user to concurrently visualize both a quilting guide on the pattern shelf, as well as the fabric. The quilting table is readily assembled, having features such as the tabs extending from the legs that slide into box channel rails. The combination of rectangular cross-section fabric bars, the hook and loop fastener on the bars and the leader fabric, and the indicia on the fabric bars facilitate the loading and the alignment of fabric onto the quilting table.

Although the preferred embodiments of the invention have been illustrated and described in detail, it will be readily apparent to those skilled in the art that various modifications may be made therein without departing from the spirit of the invention or from the scope of the appended claims. A variety of fastener types may be utilized, and additional bracing may be employed to further stabilize the quilting table.

What is claimed is:

1. A quilting table for use with a sewing machine comprising:

a frame including first and second side rails, said first and second side rails supporting a front box channel rail in opposing relationship with a rear box channel rail, said front and rear rails defining a longitudinal dimension of said frame, and said first and second side rails defining a transverse dimension of said frame;

a first carriage having first grooved wheels engaged with first and second facing edges of said front and rear box channel rails, said first carriage being moveable relative to said longitudinal dimension; and a second carriage for supporting said sewing machine, said second carriage having second wheels engaged with opposing rails of said first carriage and moveable relative to said transverse dimension.

2. A quilting table as claimed in claim 1 wherein:

said opposing rails of said first carriage are opposing box channel rails having third and fourth facing edges; and said second wheels are second grooved wheels engaged with said third and fourth facing edges of said opposing box channel rails.

3. A quilting table as claimed in claim 1 further comprising:

a first support coupled to said first side rail;

a second support coupled to said second side rail;

a payout bar extending between said first and second supports, said payout bar including a first end rotatably engaged with said first support, and said payout bar being configured to have a fabric wound thereon;

a first stop coupled to said first end for imparting a first compressive force to said first support and said payout bar for selectively preventing rotation of said payout bar;

a take-up bar extending between said first and second supports, said take-up bar including a second end rotatably engaged with said first support, and said take-up bar being configured to have said fabric wound thereon as said fabric is unwound from said payout bar; and a second stop coupled to said second end for imparting a second compressive force to said first support and said take-up bar for selectively preventing rotation of said take-up bar.

4. A quilting table as claimed in claim 3 wherein said payout bar is a first payout bar, said fabric is a first fabric, and said quilting table further comprises:

a second payout bar extending between said first and second supports and configured to have batting wound thereon; and a third payout bar extending between said first and second supports and configured to have a second fabric wound thereon, wherein said first fabric, said batting, and said second fabric are concurrently unwound from corresponding ones of said first payout bar, said second payout bar, and said third payout bar to form a sandwich structure that is passed beneath a needle bar of said sewing machine and is wound onto said take-up bar.

5. A quilting table for use with a sewing machine comprising:

a frame including first and second side rails, said first and second side rails supporting a front box channel rail in opposing relationship with a rear box channel rail, said front and rear rails defining a longitudinal dimension of said frame, and said first and second side rails defining a transverse dimension of said frame;

a first carriage having first grooved wheels engaged with first and second facing edges of said front and rear box channel rails, said first carriage being moveable relative to said longitudinal dimension;

a second carriage for supporting said sewing machine, said second carriage having second wheels engaged with opposing rails of said first carriage and moveable relative to said transverse dimension;

a first support coupled to said first side rail, said first support including a first slotted aperture extending inwardly from an outer perimeter of said first support;

a second support coupled to said second side rail, said second support including a second slotted aperture extending inwardly from an outer perimeter of said second support;

a payout bar extending between said first and second supports, said payout bar including a first end rotatably engaged with said first support, said first end of said payout bar being seated in said first slotted aperture, and said payout bar being configured to have a fabric wound thereon;

a first stop coupled to said first end for imparting a first compressive force to said first support and said payout bar for selectively preventing rotation of said payout bar;

a take-up bar extending between said first and second supports, said take-up bar including a second end rotatably engaged with said first support, said second end of said take-up bar being seated in said second slotted aperture, and said take-up bar being configured to have said fabric wound thereon as said fabric is unwound from said payout bar; and a second stop coupled to said second end for imparting a second compressive force to said first support and said take-up bar for selectively preventing rotation of said take-up bar.

6. A quilting table as claimed in claim 3 wherein each of said payout and take-up bars exhibits a generally rectangular cross-sectional shape.

7. A quilting table for use with a sewing machine comprising:

a frame including first and second side rails, said first and second side rails supporting a front box channel rail in opposing relationship with a rear box channel rail, said front and rear rails defining a longitudinal dimension of said frame, and said first and second side rails defining a transverse dimension of said frame;

a first carriage having first grooved wheels engaged with first and second facing edges of said front and rear box channel rails, said first carriage being moveable relative to said longitudinal dimension;

a second carriage for supporting said sewing machine, said second carriage having second wheels engaged with opposing rails of said first carriage and moveable relative to said transverse dimension;

a first support coupled to said first side rail;

a second support coupled to said second side rail;

a payout bar extending between said first and second supports, said payout bar including a first end rotatably engaged with said first support, and said payout bar being configured to have a fabric wound thereon, said fabric including a leading edge to which a leader fabric is coupled, said leader fabric having one of a hook and a loop fastener attached thereto;

a first stop coupled to said first end for imparting a first compressive force to said first support and said payout bar for selectively preventing rotation of said payout bar;

a take-up bar extending between said first and second supports, said take-up bar including a second end rotatably engaged with said first support, said take-up bar being configured to have said fabric wound thereon as said fabric is unwound from said payout bar, and each of said payout bar and said take-up bar includes the other of said hook and said loop fastener attached thereto for attachment with said leader fabric; and a second stop coupled to said second end for imparting a second compressive force to said first support and said take-up bar for selectively preventing rotation of said take-up bar.

8. A quilting table for use with a sewing machine comprising:

a frame including first and second side rails, said first and second side rails supporting a front box channel rail in opposing relationship with a rear box channel rail, said front and rear rails defining a longitudinal dimension of said frame, and said first and second side rails defining a transverse dimension of said frame;

a first carriage having first grooved wheels engaged with first and second facing edges of said front and rear box channel rails, said first carriage being moveable relative to said longitudinal dimension;

a second carriage for supporting said sewing machine, said second carriage having second wheels engaged with opposing rails of said first carriage and moveable relative to said transverse dimension;

a first support coupled to said first side rail;

a second support coupled to said second side rail;

a payout bar extending between said first and second supports, said payout bar including a first end rotatably engaged with said first support, and said payout bar being configured to have a fabric wound thereon;

a first stop coupled to said first end for imparting a first compressive force to said first support and said payout bar for selectively preventing rotation of said payout bar;

a take-up bar extending between said first and second supports, said take-up bar including a second end rotatably engaged with said first support, said take-up bar being configured to have said fabric wound thereon as said fabric is unwound from said payout bar, and each of said payout and take-up bars including indicia for facilitating placement of said fabric on said each of said payout and take-up bars; and a second stop coupled to said second end for imparting a second compressive force to said first support and said take-up bar for selectively preventing rotation of said take-up bar.

9. A quilting table as claimed in claim 8 wherein matching ones of said indicia are located on opposing ends of said each of said payout and take-up bars.

10. A quilting table as claimed in claim 1 wherein:

said second carriage includes a front edge facing said front box channel rail and a back edge facing said rear box channel rail, said second carriage being adapted to support said sewing machine with a machine head of said sewing machine facing said front edge; and said quilting table further comprises a handle mounted on said second carriage proximate said front edge for manually translating said first and second carriages along said longitudinal and transverse dimensions.

11. A quilting table for use with a sewing machine comprising:

a frame including first and second side rails, said first and second side rails supporting a front box channel rail in opposing relationship with a rear box channel rail, said front and rear rails defining a longitudinal dimension of said frame, and said first and second side rails defining a transverse dimension of said frame;

a first carriage having first grooved wheels engaged with first and second facing edges of said front and rear box channel rails, said first carriage being moveable relative to said longitudinal dimension;

a second carriage for supporting said sewing machine, said second carriage having second wheels engaged with opposing rails of said first carriage and moveable relative to said transverse dimension, said second carriage including a front edge facing said front box channel rail and a back edge facing said rear box channel rail, said second carriage being adapted to support said sewing machine with a machine head of said sewing machine facing said front edge; and a handle mounted on said second carriage proximate said front edge for manually translating said first and second carriages along said longitudinal and transverse dimensions, said handle including a power control element configured for connection with a foot control socket of said sewing machine, wherein actuation of said power control element selectively activates said sewing machine.

12. A quilting table as claimed in claim 11 further comprising a speed control element in communication with said power control element for adjusting an operational speed of said sewing machine.

13. A quilting table for use with a sewing machine comprising:

a frame including first and second side rails, said first and second side rails supporting a front box channel rail in opposing relationship with a rear box channel rail, said front and rear rails defining a longitudinal dimension of said frame, and said first and second side rails defining a transverse dimension of said frame;

a first carriage having first grooved wheels engaged with first and second facing edges of said front and rear box channel rails, said first carriage being moveable relative to said longitudinal dimension;

a second carriage for supporting said sewing machine, said second carriage having second wheels engaged with opposing rails of said first carriage and moveable relative to said transverse dimension;

a first shelf support extending from said first side rail;

a second shelf support extending from said second side rail; and a pattern shelf coupled to each of said first and second shelf supports and extending across said longitudinal dimension of said frame.

14. A quilting table as claimed in claim 13 wherein said first and second shelf supports extend from said first and second side rails at a height sufficient to enable said pattern shelf to reside above said sewing machine.

15. A quilting table as claimed in claim 13 wherein said first shelf support is coupled to said first side rail above said rear box channel rail, said second shelf support is coupled to said second side rail proximate said rear box channel rail, and each of said first and second shelf supports angle forward so that said pattern shelf resides above said frame above said front box channel rail.

16. A quilting table as claimed in claim 13 wherein said pattern shelf is configured to support a quilting guide, and said quilting table further comprises:

a pointer support coupled to said second carriage and extending above said pattern shelf; and a pointer held by said pointer support, said pointer moving in conjunction with movement of said first and second carriages to trace a pattern from said quilting guide, wherein said pattern is imparted on a fabric suspended on said frame in response to movement of said first and second carriages.

17. A quilting table as claimed in claim 16 wherein said pointer is approximately axially aligned with a needle bar of said sewing machine.

18. A quilting table for use with a sewing machine comprising:

a frame including first and second side rails, said first and second side rails supporting a front rail in opposing relationship with a rear rail, said front and rear rails defining a longitudinal dimension of said frame, and said first and second side rails defining a transverse dimension of said frame; and a first carriage having first wheels engaged with said front and rear rails and moveable relative to said longitudinal dimension; and a second carriage having second wheels engaged with opposing rails of said first carriage and moveable relative to said transverse dimension, said second carriage having a front edge facing said front rail and a back edge facing said rear rail, and said second carriage being adapted to support said sewing machine with a machine head of said sewing machine facing said front edge;

a handle mounted on said second carriage proximate said front edge for manually translating said first and second carriages along said longitudinal and transverse dimensions;

a first shelf support extending from said first side rail;

a second shelf support extending from said second side rail; and a pattern shelf coupled to each of said first and second shelf supports and extending across said longitudinal dimension of said frame.

19. A quilting table as claimed in claim 18 wherein said handle comprises a power control element configured for connection with a foot control socket of said sewing machine, and actuation of said power control element selectively activates said sewing machine.

20. A quilting table as claimed in claim 19 wherein said first and second shelf supports extend from said first and second side rails at a height sufficient to enable said pattern shelf to reside above said sewing machine.

21. A quilting table as claimed in claim 18 wherein said pattern shelf is configured to support a quilting guide, and said quilting table further comprises:

a pointer support coupled to said second carriage and extending above said pattern shelf; and a pointer held by said pointer support, said pointer moving in conjunction with movement of said platform assembly to trace a pattern from said quilting guide, wherein said pattern can be imparted on a fabric suspended on said frame in response to movement of said platform assembly.

* * * * *